US012668409B2

(12) United States Patent
Barreto et al.

(10) Patent No.: US 12,668,409 B2
(45) Date of Patent: Jun. 30, 2026

(54) CONTAINER CARRIER

(71) Applicant: ILLINOIS TOOL WORKS INC., Glenview, IL (US)

(72) Inventors: Kayla E. Barreto, Huntley, IL (US); Christopher J. Samaras, Tinley Park, IL (US); George P. Moreland, Greer, SC (US); Jimmy D. Whitten, Westminster, SC (US); Michael C. Czarnecki, Jr., Bensenville, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 18/639,553

(22) Filed: Apr. 18, 2024

(65) Prior Publication Data

US 2024/0351765 A1 Oct. 24, 2024

Related U.S. Application Data

(60) Provisional application No. 63/460,466, filed on Apr. 19, 2023.

(51) Int. Cl.
*B65D 71/50* (2006.01)

(52) U.S. Cl.
CPC ..... *B65D 71/504* (2013.01)

(58) Field of Classification Search
CPC ..... B65D 71/504; B65D 71/50; B65D 71/44; B65D 71/40; B65D 71/42
USPC ..... 206/151, 427, 158; 294/87.2
See application file for complete search history.

(56) References Cited

U.S. PATENT DOCUMENTS 2,936,070 A * 5/1960 Poupitch ..... B65D 71/504 294/87.2
5,139,137 A * 8/1992 Marco ..... B65D 71/504 294/87.2
5,706,936 A * 1/1998 Bernstein ..... B65D 71/44 206/148
5,884,757 A * 3/1999 Prince ..... B65D 71/50 206/427

(Continued)

FOREIGN PATENT DOCUMENTS

CN 2466080 Y 12/2001

OTHER PUBLICATIONS

ISA/US, English language verison of the International Search Report, Form PCT/ISA/210, for International Application PCT/US2024/025328, Jul. 15, 2024 (05 pages).

(Continued)

*Primary Examiner* — Steven A. Reynolds
(74) *Attorney, Agent, or Firm* — Pauley Erickson & Swanson

(57) ABSTRACT

A container carrier forming a package of unitized containers includes a network of molded ribs forming a plurality of container receiving openings formed in a plane. An arrangement of inwardly extending tabs are formed in each container receiving opening toward a center of each container receiving opening. A handle is formed along one edge of the container carrier. The container carrier is engageable with a circumferential groove around a perimeter of a sidewall of each container so that each tab of the arrangement of tabs engages with the circumferential groove of a corresponding container of the plurality of containers.

12 Claims, 5 Drawing Sheets

(56) References Cited

U.S. PATENT DOCUMENTS

| | | | | |
|---|---|---|---|---|
| 6,006,902 | A * | 12/1999 | Weaver | B65D 71/504 206/150 |
| 7,510,075 | B2 * | 3/2009 | Olsen | B65D 71/504 206/427 |
| 11,420,802 | B2 * | 8/2022 | Kooc | B65D 71/42 |
| 11,623,804 | B2 * | 4/2023 | Slovik | B65D 71/504 206/145 |
| 2004/0007480 | A1 * | 1/2004 | Pattee | B65D 73/0042 206/199 |
| 2004/0256250 | A1 * | 12/2004 | Borg | B65D 71/50 206/139 |
| 2005/0167289 | A1 * | 8/2005 | Borg | A45F 5/102 294/87.2 |
| 2007/0193889 | A1 * | 8/2007 | Olsen | B65D 71/504 206/150 |
| 2014/0300026 | A1 | 10/2014 | Taccolini | |
| 2018/0170638 | A1 * | 6/2018 | Patton | B65D 71/50 |
| 2018/0178961 | A1 | 6/2018 | Choi | |
| 2019/0016515 | A1 * | 1/2019 | Borg | B65D 71/50 |
| 2019/0119019 | A1 * | 4/2019 | Patton | G09F 23/00 |
| 2022/0127052 | A1 * | 4/2022 | Slovik | B65D 71/504 |
| 2022/0258943 | A1 * | 8/2022 | Walling | B65D 71/40 |

OTHER PUBLICATIONS

ISA/US, Form PCT/ISA/237, Written Opinion of the International Searching Authority, for International Application PCT/US2024/025328, Jul. 15, 2024 (06 pages).

* cited by examiner

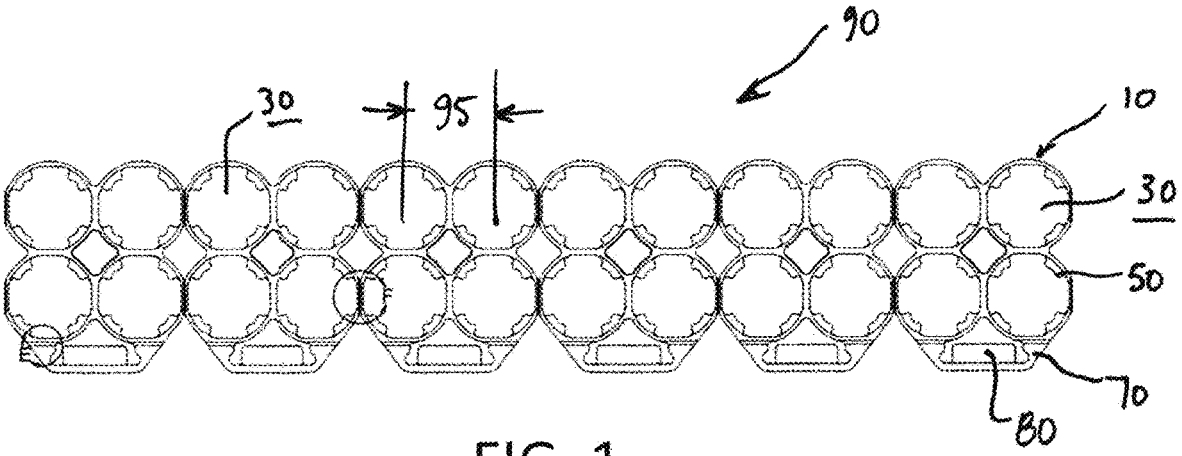
FIG. 1
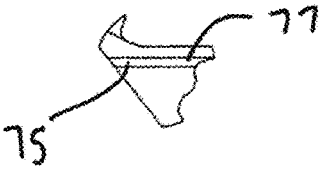
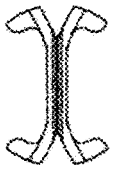
FIG. 2 FIG. 3
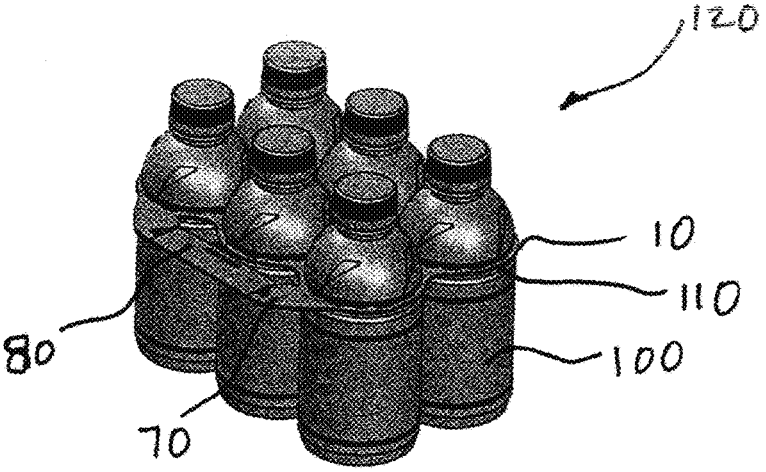
FIG. 4

CONTAINER CARRIER

CROSS REFERENCE TO RELATED APPLICATION

This application claims the benefit of U.S. Provisional Application, Ser. No. 63/460,466, filed on 19 Apr. 2023. The provisional application is hereby incorporated by reference herein in its entirety and is made a part hereof, including but not limited to those portions which specifically appear hereinafter.

BACKGROUND OF THE INVENTION

Field of the Invention

This invention relates generally to beverage multipacks and, more particularly, to multipacks made up of a plurality of containers.

Description of Prior Art

Conventional container carriers are often used to unitize a plurality of similarly sized containers, such as cans, bottles, jars and boxes and/or similar containers that require unitization. Flexible plastic ring carriers and paperboard boxes are two such conventional container carriers.

However, with growing concerns surrounding the environmental impact of improper disposal of plastic waste, manufacturers are transitioning offerings to best support a circular economy. One such solution is plastic ring carriers made from 50% post-consumer recycled content. This carrier is operationally efficient, competitively priced, simple, and has a low carbon footprint in comparison to other beverage multipack alternatives. Today, this flexible solution is not considered 100% curbside recyclable by the FTC Green Guide because 60%+ consumers cannot recycle flexible plastics.

Multi-packaging systems are generally used in the beer, soft drink, and general products industries. A new and innovative beverage multipackaging solution is desirable that includes a 4, 6, 8, and/or 12 beverage capacity. A preferred design is produced using 100% curbside recyclable rigid plastics, like HDPE or PET. These carriers would be applied on PET bottles and/or aluminum cans.

SUMMARY OF THE INVENTION

The invention generally relates to a container carrier for unitizing a plurality of containers into a multipack.

A preferred embodiment of the subject invention is made from materials that are 100% curbside recyclable, in particular rigid PET and HDPE plastics that can enter most municipal recycling streams. This invention focuses on end-user needs and structural plastics that can easily be recycled. A solution that is meaningful, practical and makes a positive impact to encourage people to recycle is desired.

Moreover, the subject invention preferably leverages contours and/or features of the containers to ensure a reliable and sturdy package. According to one preferred embodiment, container engaging apertures and/or features of such apertures are engageable within the contours and/or features of the respective containers.

Other objects and advantages will be apparent to those skilled in the art from the following detailed description taken in conjunction with the appended claims and drawings.

BRIEF DESCRIPTION OF THE DRAWINGS

FIG. 1 shows a top plan view of a stick of container carriers, each container carrier for unitizing four containers according to one embodiment;

FIG. 2 shows a detail view of the container carrier shown in FIG. 1;

FIG. 3 shows a detail view of the container carrier shown in FIG. 1;

FIG. 4 shows a package of six containers according to one embodiment;

DETAILED DESCRIPTION OF THE INVENTION

The present invention provides a container carrier to unitize a plurality of containers into beverage multipacks. Container carriers and various unitized packages of containers according to various embodiments of this invention are shown in FIGS. 1-13.

According to a preferred embodiment of this invention, the container carrier 10 is injection molded or otherwise formed from high density polyethylene (HDPE). Alternatively, PET or HDPE plastics may be used. Preferably, the material is generally rigid and 100% post-consumer recyclable in most or all markets.

Once manufactured, the container carrier 10 may be applied to groups of containers 100 to make completed unitized multipacks or packages 120. Although much of the disclosure shows and describes six pack multipacks, it is further contemplated that 4 packs, 8 packs, 10 packs and 12 packs may be unitized without departing from the essential features of this invention.

Figure 5:
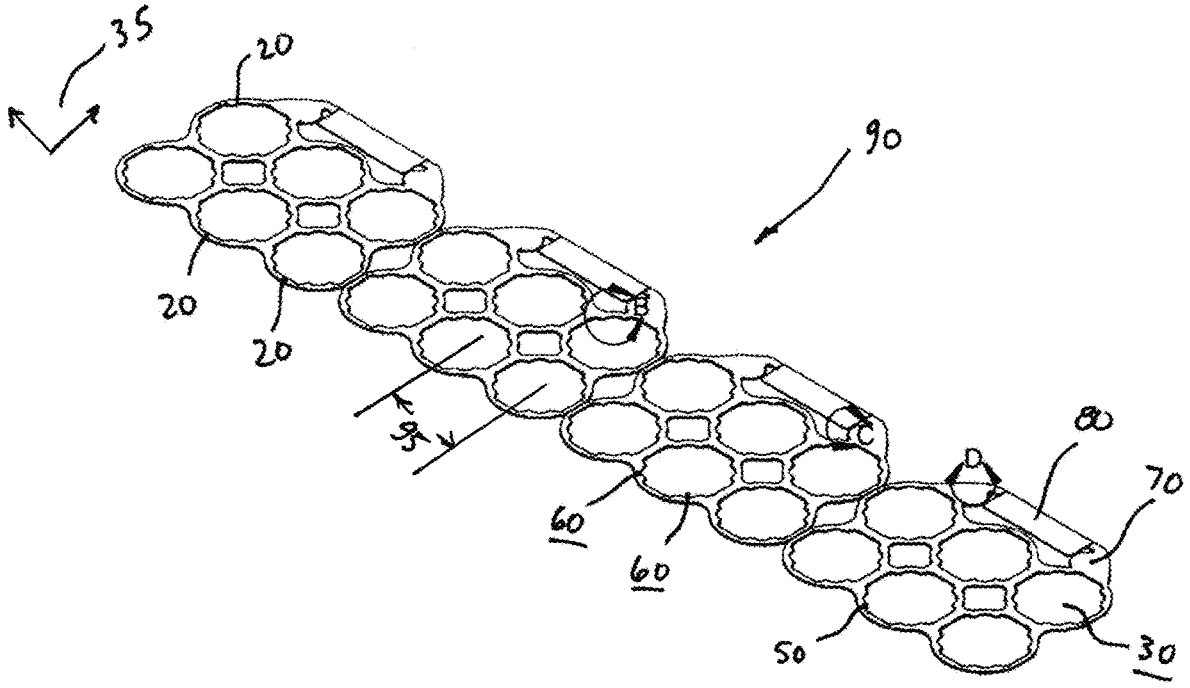
FIG. 5 shows a top perspective view of a stick of container carriers, each container carrier for unitizing six containers according to one embodiment.
Figure 6:
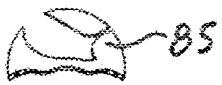
FIG. 6 shows a detail view of the container carrier shown in FIG. 5.
Figure 7:
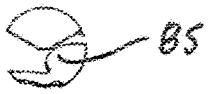
FIG. 7 shows a detail view of the container carrier shown in FIG. 5.
Figure 8:
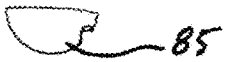
FIG. 8 shows a detail view of the container carrier shown in FIG. 5.
Figure 9:
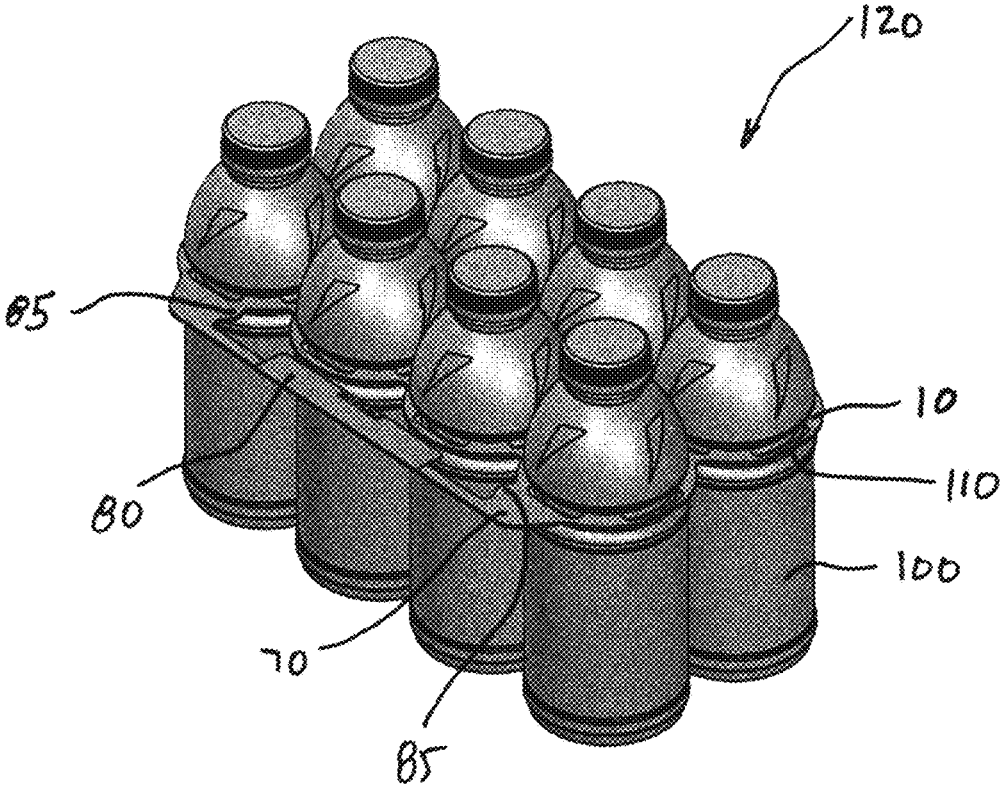
FIG. 9 shows a package of six containers according to one embodiment.
Figure 10:
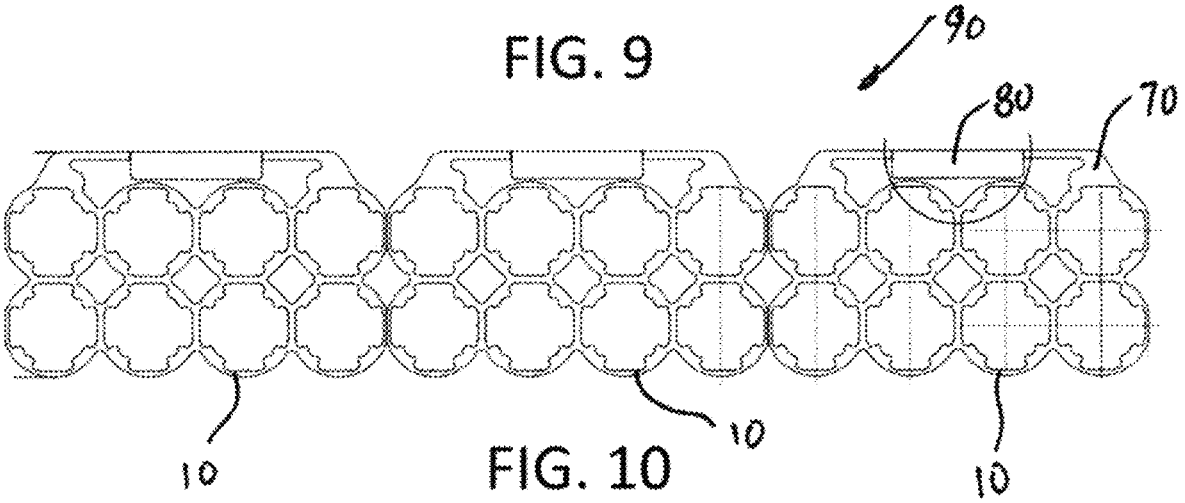
FIG. 10 shows a top plan view of a stick of container carriers, each container carrier for unitizing eight containers according to one embodiment.
Figure 11:
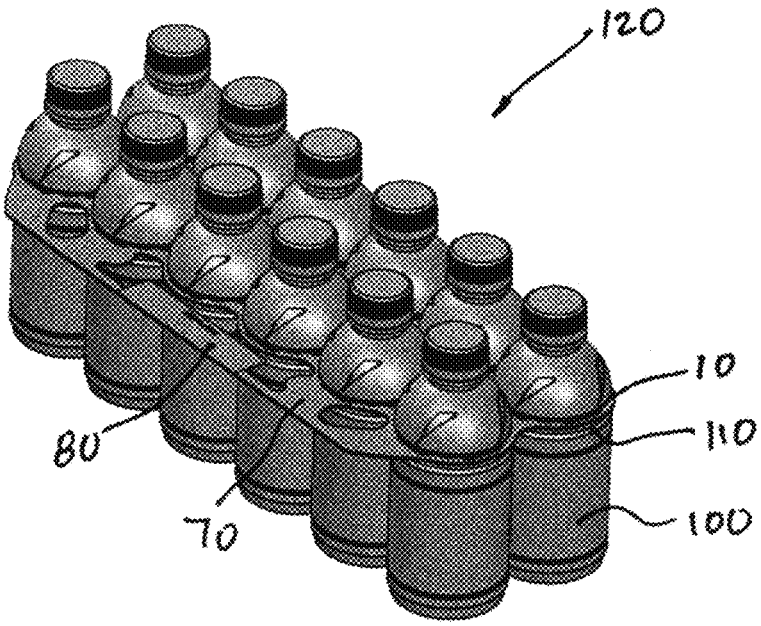
FIG. 11 shows a package of twelve containers according to one embodiment.
Figure 12:
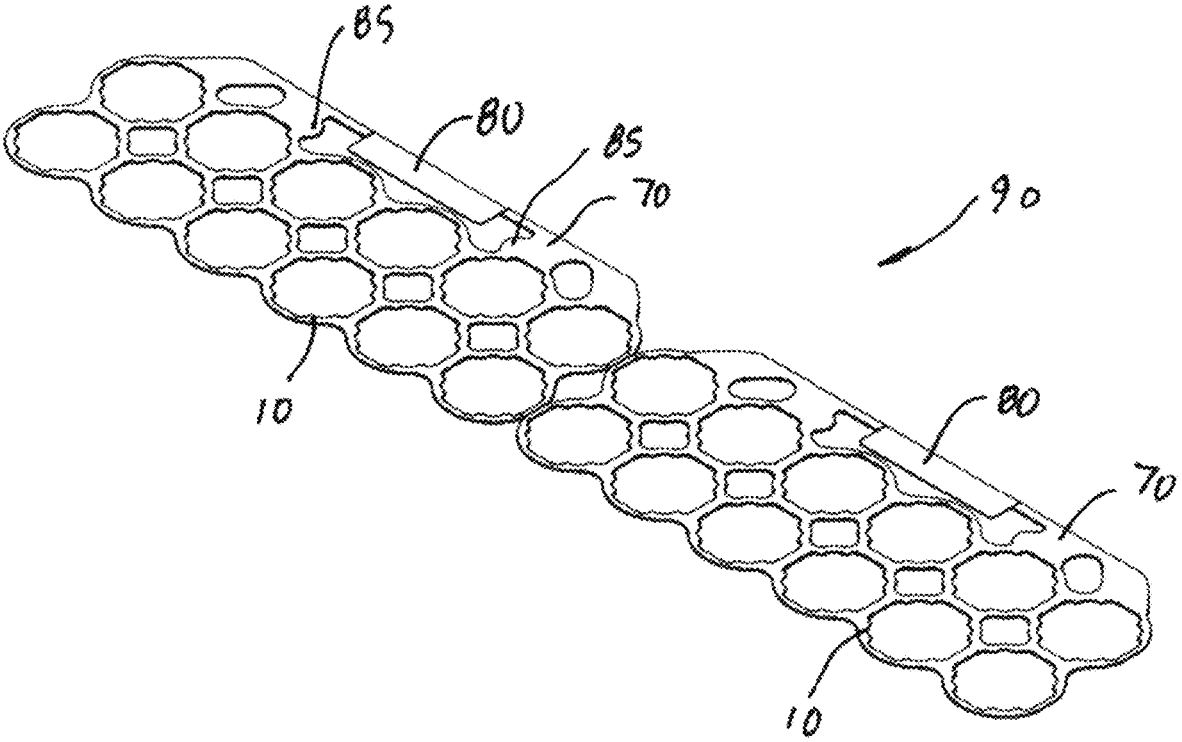
FIG. 12 shows a top perspective view of a stick of container carriers, each container carrier for unitizing twelve containers according to one embodiment.

In a preferred embodiment of this invention, the container carrier 10 includes a network of molded ribs 20 forming a plurality of container receiving openings 30 corresponding with a desired size of multipack. As such, although FIGS. 4 and 5 show six container receiving openings in a 2×3 array, other desired container carriers may be 2×2 for a four pack, such as shown in FIG. 1, 2×4 for an eight pack, such as shown in FIGS. 9 and 10, 2×6 for a twelve pack, such as shown in FIGS. 11 and 12, or other desired arrays forming a desirable quantity multipack size.

The plurality of container receiving openings 30 are preferably formed in a plane 35. As used herein, the plane 35 generally includes at least one side of the container carrier that is entirely planar. Although the container carrier 10 described includes some thickness, the thickness is generally negligible compared to a footprint of the container carrier 10, particularly in the embodiments shown in FIGS. 1-12.

As shown for example in FIG. 1, a stick 90 of adjacent container carriers 10 for unitizing a plurality of containers include a network of molded ribs 20 forming a plurality, in this case four, container receiving openings 30. An arrangement of inwardly extending tabs 50 are formed in each container receiving opening 30 toward a center of each container receiving opening 30. A similar stick 90 of container carriers 10 forming a six pack of containers 100 is shown in FIG. 5. A similar stick 90 of container carriers 10 forming an eight pack of containers 100 is shown in FIG. 9. A similar stick 90 of carriers forming a twelve pack of containers 100 is shown in FIG. 12. Such groupings or "sticks" 90 of carriers 10 are described in more detail below.

Each tab 50 of the arrangement of tabs 50 are engageable with a circumferential groove 110 in a corresponding container 100 of the plurality of containers 100 to form the package shown in FIG. 4. A handle 70 is preferably formed along one edge of the container carrier 10. The handle 70 may be grasped by the consumer to form a comfortable, compact, tightly unitized plurality of containers 100 within the package 120.

Each tab 50 of the arrangement of tabs 50 preferably comprises a central depression 60 and the arrangement of tabs 50 are preferably positioned equidistantly around an inner edge of each opening 30 of the plurality of container receiving openings 30. According to embodiments shown in FIGS. 1, 5, 10, and 12, the tabs 50 are 45 degrees offset from a longitudinal direction of the respective carrier 10.

In a preferred embodiment, each tab 50 comprises a thickness less than a thickness of the network of molded ribs 20 forming the plurality of container receiving openings 30. By reducing a thickness of the tabs 50, the containers 100 may be applied and, particularly, removed with less effort than tabs 50 having a full thickness. This assists the consumer in removing containers 100 from the package 120 without undue force.

In a preferred embodiment, a hinge 75 is formed between the handle 70 and the one edge of the container carrier 10. The hinge 75 may be formed with a reduced thickness of material between the one edge of the container carrier 10 and the handle 70. More specifically, the hinge 75 may comprise a fillet 77, specifically a semi-circular or triangular groove, extending across the one edge of the container carrier 10. According to one embodiment, the reduced thickness or fillet 77 is positioned along an underside of the container carrier 10. In such an arrangement, the handle 70 may be urged downward after application to permit a more compact package 120 without undue interference from an outwardly extending handle 70.

According to one embodiment, the handle 70 may further comprise a panel 80 extending toward the one edge of the container carrier 10. The panel 80 may comprise a reduced thickness of material from the network of molded ribs 20. The reduced thickness of panel 80 enables a comfortable contour to be formed in association with a consumer's hand while carrying. The panel 80 may be used to accommodate product labelling, bar coding, promotional information, ingredients and/or other information relevant to the package 120. According to one embodiment, the handle 70 includes a pair of tabs 85 that extends toward the panel 80. The tabs 85 preferably reduce or eliminate concentration of forces on the hinge 75 of the handle.

FIGS. 2, 3, 6, 7, and 8 show various details of preferred embodiments of the subject container carrier 10.

The subject design results in resin reduction per 6-pack carrier (total mass reduction). In addition, application and manufacturing efficiency are improved particularly in the 2×12 design. The subject design may also accommodate high speed application for high application efficiency that can be used in standard bottle lines—which current curbside recyclable beverage multipacks struggle to meet. Further, the side-applied attachment method allows for a uniform pack size, stability, function similar to traditional flexible multipacks without damaging bottle labels. Store merchandising is also improved through the subject design because of ease of the foldable handle design and pack integrity. The tabbed bottle retention feature further permit the container carrier to be applied to differing bottle shapes and sizes As shown in FIGS. 1, 5, 10, and 12, the container carrier 10 may be grouped in segments or "sticks" 90 of two to six container carriers 10 connected in a unitized stick 90. Such sticks 90 may or may not include frangible connection points between adjacent container carriers 10. In one embodiment, a notch may be positioned between adjacent container carriers 10 in a stick 90 to allow for carriers 10 to be configured into a chain-linked stick 90. For ease of application to containers and handling of bulk container carriers 10, a pitch 95, or longitudinal distance, between adjacent container receiving openings 30 is constant throughout the stick 90. As such, the pitch 95 between container receiving openings 30 within a single container carrier 10 is the same as the pitch 95 between edge container receiving openings 30 of adjacent container carriers 10 that are joined within the stick 90.

Figure 13:
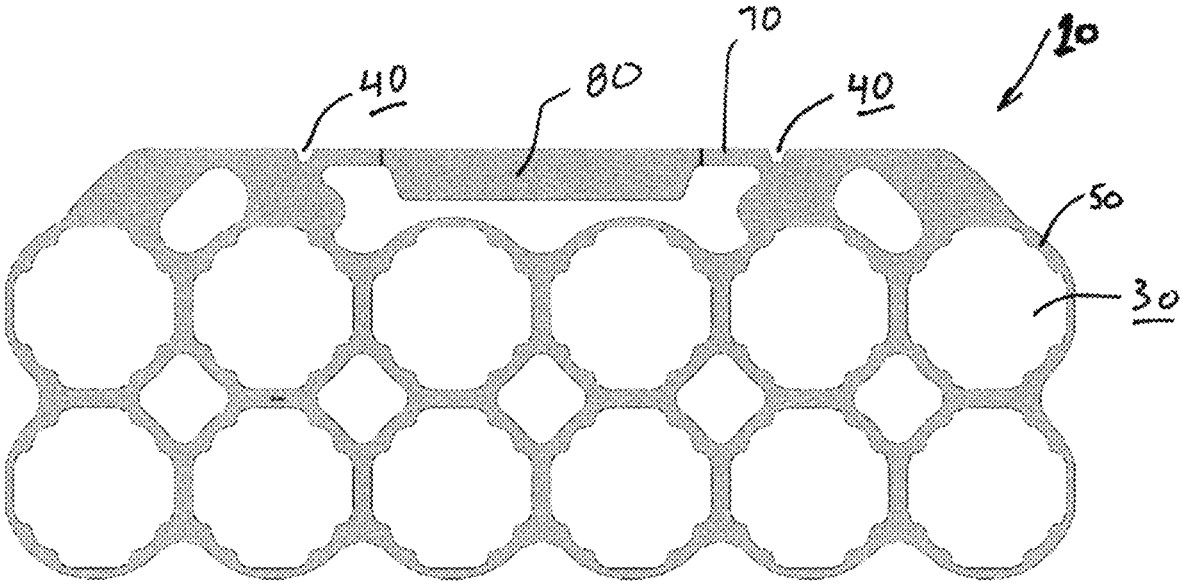
FIG. 13 shows a top plan view of a container carrier for unitizing twelve containers according to one embodiment.

FIG. 13 shows one embodiment of a container carrier 10 for unitizing twelve containers. The container carrier 10 according to this embodiment includes a notch 40 positioned on each side of the handle 70 along an edge of the container carrier 10. The notches 40 are preferably generally trapezoidal in shape and are designed to relieve stresses imparted on the handle 70 when carried by a consumer.

According to another embodiment, container carriers 10 may include a sacrificial link or attachment point between edges of the panel 80 and ribs 20 of the carrier 10. Although not shown in the drawings, such a sacrificial link may assist during application of the carrier 10 to maintain a generally flat carrier 10 or stick 90 of carriers as the carrier 10 gets applied to containers in an applicating machine.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A container carrier for unitizing a plurality of containers, the container carrier comprising:

a network of molded ribs forming a plurality of container receiving openings;

an arrangement of inwardly extending tabs formed in each container receiving opening toward a center of each container receiving opening, each tab of the arrangement of tabs engageable with a circumferential groove in a corresponding container of the plurality of containers, wherein each tab of the arrangement of tabs comprises a central depression and the arrangement of tabs are positioned equidistantly around an inner edge of the plurality of container receiving openings and wherein each tab comprises a thickness less than a thickness of the network of molded ribs forming the plurality of container receiving openings;

a handle formed along one edge of the container carrier; and wherein two to four container carriers are connected in a unitized stick and a pitch between adjacent container receiving openings is constant throughout the stick.

2. The container carrier of claim 1 further comprising a hinge formed along one edge of the handle.

3. The container carrier of claim 2 wherein the hinge is formed with a reduced thickness of material.

4. The container carrier of claim 3 wherein the hinge comprises a fillet extending across the one edge of the container carrier.

5. The container carrier of claim 4 wherein the fillet is positioned along an underside of the container carrier.

6. The container carrier of claim 1 wherein the handle further comprises a panel.

7. The container carrier of claim 6 wherein the panel comprises a reduced thickness of material from the network of molded ribs.

8. The container carrier of claim 1 further comprising a notch in an edge of the container carrier formed on each side of the handle.

9. A container carrier for unitizing a plurality of containers, the container carrier comprising:

a network of molded ribs forming a plurality of container receiving openings;

an arrangement of inwardly extending tabs formed in each container receiving opening toward a center of each container receiving opening, each tab of the arrangement of tabs engageable with a circumferential groove in a corresponding container of the plurality of containers;

a handle formed along one edge of the container carrier;

a hinge formed between the handle and the one edge of the container carrier, wherein the hinge is formed with a reduced thickness of material between the one edge of the container carrier and the handle and includes a fillet extending across the one edge of the container carrier along an underside of the container carrier; and wherein two to four container carriers are connected in a unitized stick and a pitch between adjacent container receiving openings is constant throughout the stick.

10. The container carrier of claim 9 wherein the arrangement of tabs are positioned equidistantly around an inner edge of the plurality of container receiving openings.

11. The container carrier of claim 10 wherein each tab comprises a thickness less than a thickness of the network of molded ribs forming the plurality of container receiving openings.

12. A container carrier for unitizing a plurality of containers, the container carrier comprising:

a network of molded ribs forming a plurality of container receiving openings;

an arrangement of inwardly extending tabs formed in each container receiving opening toward a center of each container receiving opening, each tab of the arrangement of tabs engageable with a circumferential groove in a corresponding container of the plurality of containers; and a handle formed along one edge of the container carrier that further comprises a panel extending toward the one edge of the container carrier, wherein the panel comprises a reduced thickness of material from the network of molded ribs; and wherein two to four container carriers are connected in a unitized stick and a pitch between adjacent container receiving openings is constant throughout the stick.

* * * * *